US006776578B2

(12) United States Patent
Belady

(10) Patent No.: US 6,776,578 B2
(45) **Date of Patent: *Aug. 17, 2004**

(54) WINGLET-ENHANCED FAN

(75) Inventor: Christian L. Belady, McKinney, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 44 days.

This patent is subject to a terminal disclaimer.

(21) Appl. No.: 10/304,923

(22) Filed: Nov. 26, 2002

(65) Prior Publication Data

US 2003/0077172 A1 Apr. 24, 2003

Related U.S. Application Data

(63) Continuation-in-part of application No. 09/867,194, filed on May 29, 2001, now Pat. No. 6,517,315.

(51) Int. Cl.[7] ..... F01D 1/00

(52) U.S. Cl. ..... 415/221; 415/228; 415/200; 416/228

(58) Field of Search ..... 415/200, 228, 415/221, 220, 189, 169 A; 416/228, 189, 1, 223 R; 361/697; 165/121, 122, 8, 80.3; 244/91, 223 R

(56) References Cited

U.S. PATENT DOCUMENTS 4,406,581 A * 9/1983 Robb et al. ..... 415/173.5
5,215,441 A * 6/1993 Evans et al. ..... 416/223 R
5,348,253 A * 9/1994 Gratzer ..... 244/91
5,437,541 A * 8/1995 Vainrub ..... 416/223 R
5,634,613 A * 6/1997 McCarthy ..... 244/199
5,785,116 A 7/1998 Wagner
5,927,944 A * 7/1999 Belady ..... 415/220
6,517,315 B2 * 2/2003 Belady ..... 415/221

OTHER PUBLICATIONS

"Comair–Rotron Models Whisper XL AC and Muffin XL AC," [Online], [Retrieved on: May 17, 2001], Retrieved from: http: http://www.comairrotron/acfans.html.

* cited by examiner

*Primary Examiner*—Edward K. Look
*Assistant Examiner*—J M McAleenan

(57) ABSTRACT

Small winglets placed at the outer end of each fan blade substantially reduce the vortices created in conventional fans by the pressure differential between the low pressure and high pressure sides of the blade. The winglet acts as a barrier, which substantially blocks leakage around the blade tip, thus suppressing vortices. Technical advantages include noise reduction, because there are no shedding vortices to create noise as the blades pass the struts; increased aerodynamic efficiency of the fan, providing higher air flow for the same fan speed, size, and power, because less energy is lost in vortices; and minimal cost impacts, because housings currently used for fans can still be used with standard finger guards and because winglets and blades can be formed integrally of injection molded plastic.

12 Claims, 2 Drawing Sheets

WINGLET-ENHANCED FAN

CROSS-REFERENCE TO RELATED APPLICATIONS

This application is a continuation-in-part of commonly assigned U.S. patent application Ser. No. 09/867,194, filed May 29, 2001, entitled "ENHANCED PERFORMANCE FAN WITH THE USE OF WINGLETS, " subsequently issued Feb. 11, 2003, as U.S. Pat. No. 6,517,315, the disclosure of which is hereby incorporated herein by reference.

FIELD OF THE INVENTION

This application relates to systems and methods for aerodynamic flow, and more particularly to an enhanced performance fan with the use of winglets.

DESCRIPTION OF THE RELATED ART

An item of electronic equipment that dissipates more power than can easily be cooled with heat sinks alone generally uses fans to supplement natural convection. This works well enough, but as anyone who has labored in a room full of fan cooled equipment can attest, the noise from the fans themselves can be rather annoying. This is especially so in an office setting, where there arise issues of decorum, in addition to the more pragmatic issues of productivity reduction owing to distractions caused by noise.

A significant amount of fan noise appears to originate with the production of turbulent vortices of air at the tips of the fan blades as they rotate about the fan axis. The tips slice sideways, as it were, through low pressure air on the inlet side of the blades and the high pressure air on the outlet side of the blades. As the blades rotate, high pressure air spills over the tips of the blades and imparts an off-axis spinning motion in the low pressure air creating vortices whose behavior results in the production of acoustic energy (noise), particularly when the blades pass the struts of the fan. In addition, the aerodynamic performance of the fan does not reach its full potential capacity due to parasitic energy losses at the blade tips.

Most commercially available fans do nothing to eliminate the noise resulting from the blade vortices. Instead, noise is managed by decreasing fan speed or blade pitch, both of which compromise the aerodynamic performance of the fan.

Accordingly, it would be desirable if fan noise could be reduced without sacrificing the air flow that fan is intended to supply

BRIEF SUMMARY OF THE INVENTION

The present invention is directed to a system and method which minimize blade tip vortices of a fan and thus reduce a noise source, resulting in a quieter higher performance fan. Small winglets (similar to those observed on aircraft wings) placed at the end of each fan blade substantially eliminate the vortices created in conventional fans by the pressure differential between the top side (low pressure) and the bottom side (high pressure) of the blade. The winglet acts as a barrier between the low pressure and high pressure sides of a blade, which prevents leakage around the tip, thus suppressing vortices. The winglet can be placed at the end of the blade opposite the hub on either top, bottom, or both top and bottom of the blade.

Technical advantages of embodiments of this invention include noise reduction, because there are no shedding vortices to create noise as the blades pass the struts; increased aerodynamic efficiency of the fan, providing higher air flow and/or static pressure for the same fan speed, size, and power, because energy is not lost in vortices; and minimal cost impacts, because housings currently used for fans can still be used with standard finger guards and because the blades are typically plastic injection molded.

DETAILED DESCRIPTION

Figure 1A:
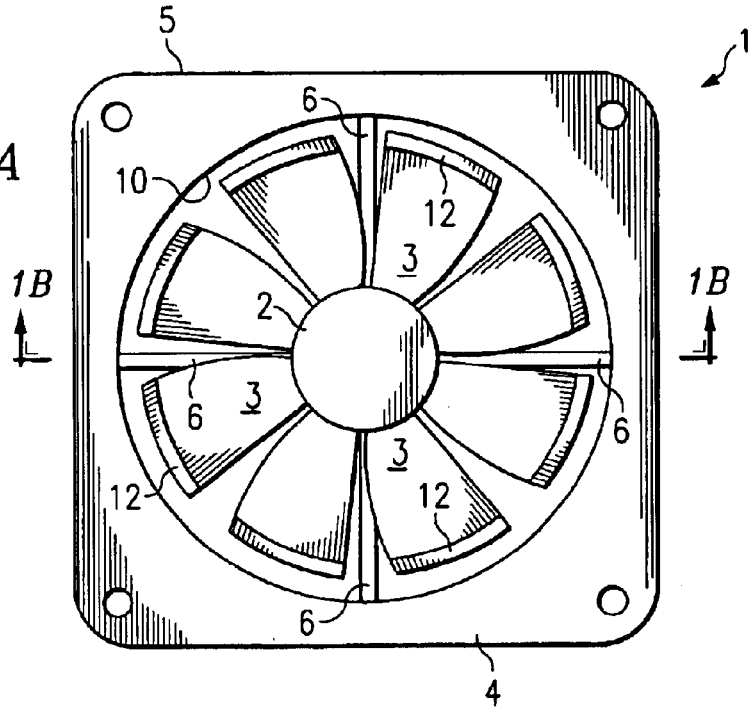
FIGS. 1A, 1B, and 1C are respectively a top view, a cross sectional side view, and a schematic partial perspective view depicting a fan constructed in accordance with an embodiment of the present invention.
Figure 1B:
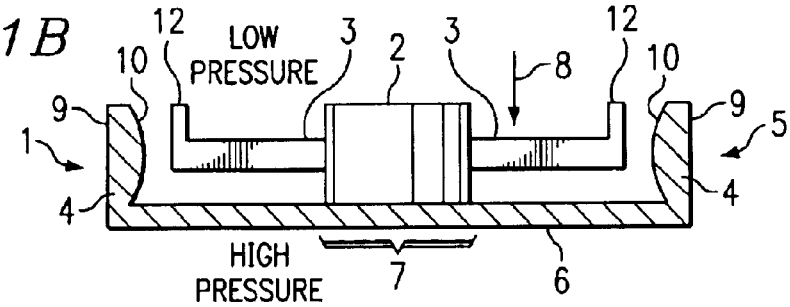
Figure 1C:
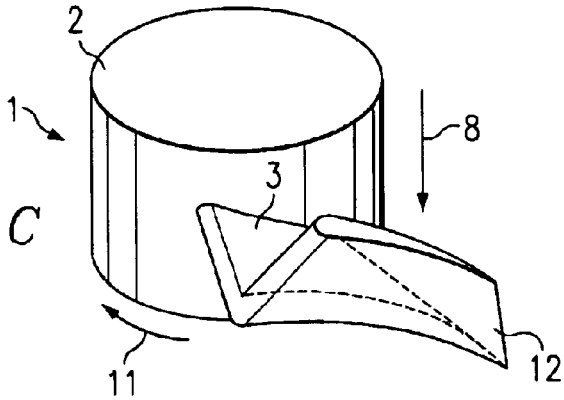

FIGS. 1A, 1B, and 1C are respectively a top view, a cross sectional side view, and a schematic partial perspective view depicting a fan 1 constructed in accordance with an embodiment of the present invention. In particular a hub 2 is rotatably mounted on a base 5 that includes an open interior region spanned by struts 6. Struts 6 support a central location 7 within base 5, onto which hub 2 is rotatably mounted. A plurality of blades 3 are attached to hub 2, and a small motor (not shown) attached to hub 2 causes hub 2 and attached blades 3 to rotate in a direction indicated by arrow 11, creating air flow in a direction indicated by arrow 8. Fan 1 can also be designed to work such that flow is in the opposite direction. Base 5 optionally includes a stationary venturi 4 having an inner surface 10 that, in a known manner, typically resembles an airfoil rotationally symmetric about hub 2, which is closely spaced radially beyond the distal ends of rotating blades 3. Optional venturi 4 has an outer surface 9 that is not critical to the performance of fan 1 and can optionally be designed as an integral portion of a housing of fan 1. Embodiments of the present invention include fans without venturi and fans with venturis having a variety of forms known to those with skill in the art. For example, a fan according to embodiments of the present invention can include a venturi similar to fan housings described in U.S. Pat. No. 5,785,116 entitled "Fan Assisted Heat Sink Device," issued Jul. 28, 1998.

A winglet 12 is attached to the end of each blade 3 distal from hub 2 on either top, bottom, or both top and bottom of the blade. Winglet 12 extends substantially circumferentially relative to the rotation axis of hub 2 and essentially perpendicular to the plane of blade 3, and is typically but not necessarily shaped as an airfoil, for example as depicted in FIG. 1C, which for simplicity shows only one blade 3 with one attached winglet 12. In some embodiments, winglet 12 extends a distance in the circumferential direction substantially equal to the circumferential width of the tip of blade 3. In some embodiments, winglet 12 is formed as an integral part of blade 3, whereas in other embodiments winglet 12 and blade 3 are formed separately and are joined together. Winglet 12 and blade 3 can be formed of a variety of structural materials, including by way of example and not by way of restriction metals, insulators, polymers, elastomers, concretes, and composites. Particularly, winglet 12 and blade 3 can be integrally formed of injection molded plastic.

In operation, winglets 12 (similar to structures observed on aircraft wings) placed at the distal end of fan blades 3 act as a barrier to air flow around the blade tips between the top side (low pressure) and the bottom side (high pressure) of a blade 3 as illustrated in FIG. 1B, thus reducing leakage around the blade tips and consequently suppressing the shedding vortices caused by that leakage in a conventional fan.

It is noted that, in accordance with aerodynamic principles, if the rotation direction indicated by arrow 11 of fan 1 is reversed, then the air flow direction indicated by arrow 8 is consequently reversed, i.e., air flows over struts 6 and then over blades 3. This reversal of air flow direction in turn reverses the respective locations of high and low pressure sides of the fan relative to blades 3, such that in FIG. 1B the high pressure side would be at the top in the diagram and the low pressure side would be at the bottom in the diagram. Although fan 1 with attached winglets 12 operates in principle under these reverse-flow conditions, performance is not optimized, because any airfoil surfaces of fan 1 are specifically shaped to optimize performance for the original respective rotation and flow directions. It is further noted that struts 6 can be either upstream or downstream of blades 3 for optimum performance in either rotation direction of blades 3.

Figure 2:
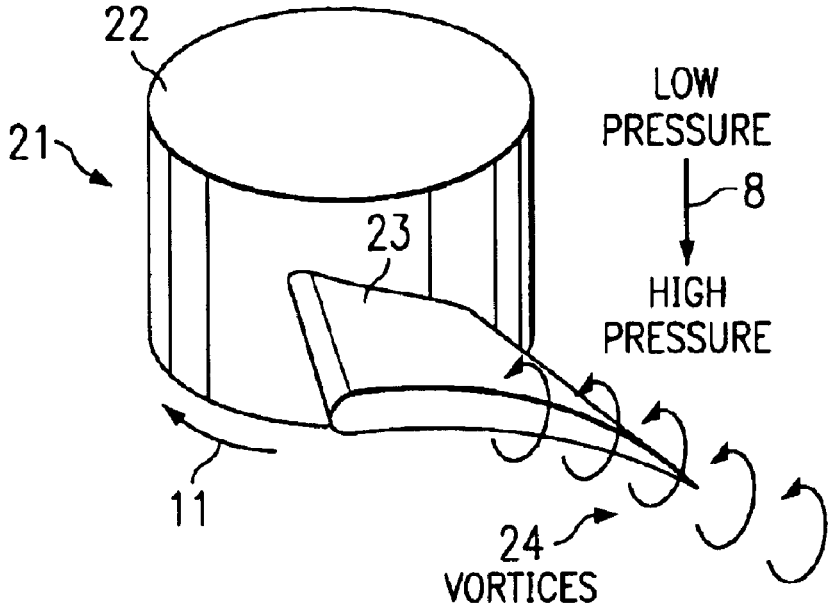
FIG. 2 (PRIOR ART)
FIG. 2 is a schematic partial perspective view depicting the structure of a conventional prior art fan.

FIG. 2 is a schematic partial perspective view depicting the structure of a conventional fan 21. A plurality of blades, represented for simplicity by single blade 23, are attached radially to a hub 22, which is mounted rotatably on a base (not shown in FIG. 2). Hub 22 and attached blades 23 rotate in a direction indicated by arrow 11, creating primary air flow in a direction indicated by arrow 8. The primary air flow in direction 8 creates an air pressure gradient between the top or low pressure intake side and the bottom or high pressure outlet side of blades 23. This pressure gradient in turn drives a leakage flow around the tips of blades 23. Because there is no barrier to this leakage flow, it persists and leads to shedding vortices 24 in the wake of spinning blade 23, which create noise and reduce aerodynamic efficiency as blades 23 rotate.

Figure 3:
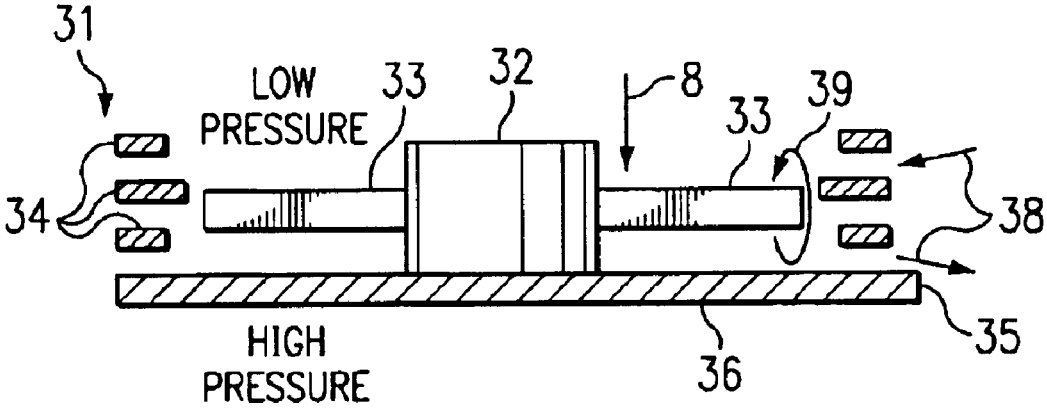
FIG. 3 (PRIOR ART)
FIG. 3 is a schematic cross section view illustrating the structure of a prior art Lamont fan.

Technical advantages of embodiments of the present invention include noise reduction, because shedding vortices that create noise are minimized; increased aerodynamic efficiency of the fan, providing higher air flow and/or static pressure for the same fan speed, size, and power, because energy is not lost in vortices; and minimal cost impacts, because housings currently used for fans can still be used with standard finger guards. The above technical advantages distinguish embodiments of the present invention over prior art approaches including: the Lamont Fan, which allows air leakage through the venturi. FIG. 3 is a schematic cross section view illustrating the structure of a Lamont fan 31, which has blades 33 attached to a rotating hub 32 mounted to a base 35 having struts 36 to create an air flow indicated by arrow 8. Venturi 34 is segmented to provide a bypass 38 to leakage flow 39, which weakens shedding vortices 24. However, this can reduce the aerodynamic performance of the fan, shedding vortices still develop, and the venturi is broken up; another prior art approach incorporates blades with serrated edges on the trailing edge, currently used by only one manufacturer (see for example Rotron Models Whisper® XLAC and Muffin® XLAC, http//www.comairrotron/acfans.htm), with no apparent practical advantage over conventional technology.

In the Integral Rotating Venturi fan, according to U.S. Pat. No. 5,927,944, issued Jul. 27, 1999, the gap between the blade tip and venturi is eliminated by attaching the venturi to the blade, so that the venturi spin with the blade. Although this technique is effective in eliminating shedding vortices, disadvantages include rotating venturi, which can be a safety concern. Additionally, the mass of rotating blade/venturi is higher than in typical fan design, increasing energy consumption and adversely affecting bearing reliability and rotor balancing. Also, tolerances associated with the clearance between the rotating venturi and the stationary housing can be difficult to maintain.

What is claimed is:

1. A fan operable to generate a flow of air from a low pressure region to a high pressure region comprising:

a base;

a hub rotatably mounted to said base;

a plurality of blades attached at proximal ends thereof to said hub and toward the distal ends thereof projecting in a substantially radial direction away from said hub;

a winglet attached to at least one blade of said plurality of blades distal from said hub, said winglet extending generally in a plane perpendicular to said radial direction of said blade; and said winglet providing a barrier operable to substantially block a leakage flow of air around said distal end of said blade from said high pressure region to said low pressure region.

2. The fan of claim 1 wherein said winglet has an airfoil shape.

3. The fan of claim 1 wherein said winglet is formed of a structural material selected from the group consisting of metals, insulators, polymers, elastomers, concretes, and composites.

4. The fan of claim 1 wherein said winglet is integrally formed as part of said blade.

5. The fan of claim 4 wherein said winglet and said blade are integrally formed of injection molded plastic.

6. The fan of claim 1 wherein one said winglet is attached to each blade of said plurality of blades.

7. The fan of claim 1 wherein said winglet is attached to the high pressure surface of said blade.

8. The fan of claim 1 wherein said winglet is attached to the low pressure surface of said blade.

9. The fan of claim 8 wherein said winglet is attached to the high pressure surface of said blade.

10. The fan of claim 1 wherein said base further comprises an open interior region allowing the passage of air therethrough, said interior region being bounded by a peripheral surface from which struts converge toward and meet at a substantially central location within said open interior region, said hub being rotatably mounted at said substantially central location.

11. The fan of claim 1 wherein said winglet extends in a circumferential direction for a distance substantially equal to the distal width of said blade in said circumferential direction.

12. The fan of claim 1 further comprising a venturi.

* * * * *